US008276216B2

(12) United States Patent
Carney

(10) Patent No.: US 8,276,216 B2
(45) **Date of Patent: *Oct. 2, 2012**

(54) MATERNITY GARMENT

(75) Inventor: Ingrid Carney, San Francisco, CA (US)

(73) Assignee: Ingrid & Isabel, LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/166,789

(22) Filed: Jun. 22, 2011

(65) Prior Publication Data

US 2011/0239353 A1 Oct. 6, 2011

Related U.S. Application Data

(63) Continuation-in-part of application No. 12/697,144, filed on Jan. 29, 2010, now Pat. No. 8,191,177, which is a continuation of application No. 11/435,492, filed on May 16, 2006, now Pat. No. 7,676,852, which is a continuation of application No. 10/423,224, filed on Apr. 25, 2003, now Pat. No. 7,181,775.

(51) Int. Cl.
*A41D 1/20* (2006.01)
*A41F 9/00* (2006.01)

(52) U.S. Cl. ..... 2/311; 2/338

(58) Field of Classification Search ..... 2/206, 207, 2/208, 236, 237, 311, 337, 338, 244; 602/75, 602/44, 63; 450/112, 130, 131, 133, 154, 450/155, 18, 23, 80

See application file for complete search history.

(56) References Cited

U.S. PATENT DOCUMENTS

| | | | |
|---|---|---|---|
| 404,163 | A | 5/1889 | Brunner |
| 482,401 | A | 9/1892 | Tynan |
| 514,930 | A | 2/1894 | Heath |
| 818,031 | A | 4/1906 | Kislik |
| 836,136 | A | 11/1906 | Parris |
| 1,380,605 | A | 6/1921 | Swantees |

(Continued)

FOREIGN PATENT DOCUMENTS

| | | |
|---|---|---|
| AU | 1981-68755 | 10/1980 |

(Continued)

OTHER PUBLICATIONS

New York Obersver, The (NY), Apr. 12, 1999; p. 26; Struggling for a fashion-forward pregnancy; William Norwich.*

(Continued)

*Primary Examiner* — Alissa L Hoey
(74) *Attorney, Agent, or Firm* — Carr & Ferrell LLP

(57) ABSTRACT

Maternity wear of the invention accommodates the changing shape of a woman's body during pregnancy, minimizing the need for maternity clothes. In one aspect of the invention, pants or a skirt are worn with the upper end unfastened so as to conform to the shape of the swelling torso in pregnancy, and an elastic band shaped similarly to a tube top is worn generally around the waist, so as to overlap the top of the unfastened pants or skirt and retain them on the body. A top, such as a blouse or shirt, can be worn with its tail end extending over the band. In another aspect of the invention, too-large maternity clothing is worn with the band garment engaged over the upper end. If desired the band garment can be folded over on itself, thus doubling its thickness.

17 Claims, 13 Drawing Sheets

U.S. PATENT DOCUMENTS

| | | | | | |
|---|---|---|---|---|---|
| 1,389,664 | A | | 9/1921 | Jackson | |
| 1,608,096 | A | | 11/1926 | Friedman | |
| 1,609,248 | A | * | 11/1926 | Harkins | 450/134 |
| 1,683,510 | A | * | 9/1928 | Wiese | 450/20 |
| 1,753,739 | A | | 4/1930 | Bums | |
| 1,774,613 | A | * | 9/1930 | Pidgeon | 450/20 |
| 2,040,058 | A | * | 5/1936 | Mendal et al. | 66/176 |
| 2,040,657 | A | * | 5/1936 | Kops et al. | 139/421 |
| 2,224,871 | A | * | 12/1940 | Kennedy | 66/176 |
| 2,409,601 | A | | 12/1946 | Truesdell | |
| 2,574,678 | A | | 1/1947 | Wilbur | |
| 2,579,547 | A | * | 12/1951 | Cadous | 450/112 |
| 2,606,322 | A | | 8/1952 | Vraciu | |
| 2,633,574 | A | * | 4/1953 | Dolan | 450/131 |
| 2,719,973 | A | | 10/1955 | Blatt | |
| 2,723,396 | A | * | 11/1955 | Stack | 450/58 |
| 2,787,792 | A | | 4/1957 | Mikottis | |
| 2,814,805 | A | * | 12/1957 | Blatt | 450/155 |
| 2,816,291 | A | * | 12/1957 | Blatt | 450/155 |
| 2,862,502 | A | | 12/1958 | Blatt | |
| 2,878,812 | A | | 3/1959 | Geimer | |
| 2,897,823 | A | | 8/1959 | Scheinberg | |
| 3,045,678 | A | * | 7/1962 | Geimer | 450/130 |
| 3,080,869 | A | * | 3/1963 | Alberts | 450/118 |
| 3,087,496 | A | * | 4/1963 | Norman | 450/155 |
| 3,089,149 | A | | 5/1963 | Kelleam | |
| 3,133,542 | A | * | 5/1964 | Bradd | 450/131 |
| 3,174,482 | A | * | 3/1965 | Parrott | 450/95 |
| 3,287,938 | A | * | 11/1966 | Knohl | 66/190 |
| 3,328,222 | A | | 6/1967 | Ambrose | |
| 3,401,699 | A | * | 9/1968 | Shea | 450/112 |
| 3,425,246 | A | * | 2/1969 | Knohl | 66/171 |
| 3,431,562 | A | | 3/1969 | Souders | |
| 3,487,418 | A | | 12/1969 | Jacobs | |
| 3,490,449 | A | * | 1/1970 | Ewerwahn | 450/155 |
| 3,505,685 | A | | 4/1970 | Granchelli | |
| 3,623,488 | A | | 11/1971 | Nakayama | |
| 3,703,820 | A | * | 11/1972 | Jackson | 66/177 |
| 3,793,645 | A | | 2/1974 | Kadison | |
| 3,899,900 | A | * | 8/1975 | Jackson | 66/87 |
| 3,930,090 | A | * | 12/1975 | Campbell et al. | 428/196 |
| 3,936,075 | A | | 2/1976 | Jelliffe | |
| 4,280,229 | A | * | 7/1981 | Stein | 2/221 |
| 4,472,839 | A | | 9/1984 | Johansen | |
| 4,506,390 | A | * | 3/1985 | Stern | 2/221 |
| 4,523,337 | A | | 6/1985 | Leibowitz | |
| 4,527,402 | A | | 7/1985 | Swallow | |
| 4,557,268 | A | | 12/1985 | Maddux et al. | |
| 4,580,298 | A | | 4/1986 | Tuisl | |
| 4,596,253 | A | | 6/1986 | Griffith | |
| 4,620,326 | A | | 11/1986 | Matthias, Jr. | |
| 4,642,818 | A | * | 2/1987 | Dehnert et al. | 2/400 |
| 4,697,592 | A | | 10/1987 | Maddux et al. | |
| 4,746,318 | A | * | 5/1988 | Moyer | 450/155 |
| 4,803,740 | A | | 2/1989 | Dawson | |
| 4,839,925 | A | * | 6/1989 | Panton, Jr. | 2/146 |
| 4,849,863 | A | * | 7/1989 | Gallegos | 362/108 |
| 4,873,982 | A | * | 10/1989 | Morrison | 600/300 |
| 4,952,192 | A | | 8/1990 | Burke | |
| 4,976,653 | A | | 12/1990 | White | |
| 5,016,291 | A | * | 5/1991 | Capper | 2/312 |
| 5,060,639 | A | | 10/1991 | Marcus | |
| 5,094,648 | A | * | 3/1992 | Turner | 450/155 |
| 5,144,696 | A | * | 9/1992 | Kahl | 2/207 |
| 5,163,184 | A | | 11/1992 | Reardon | |
| 5,283,910 | A | | 2/1994 | Flint | |
| 5,359,732 | A | * | 11/1994 | Waldman et al. | 2/67 |
| 5,406,964 | A | * | 4/1995 | Calleja | 128/888 |
| 5,416,928 | A | | 5/1995 | Koenig | |
| 5,492,496 | A | * | 2/1996 | Walker | 450/155 |
| 5,575,011 | A | | 11/1996 | Allen | |
| 5,611,084 | A | | 3/1997 | Garry | |
| 5,623,735 | A | | 4/1997 | Perry | |
| 5,638,550 | A | | 6/1997 | Hube | |
| 5,690,122 | A | * | 11/1997 | Weber-Unger | 128/876 |
| 5,743,783 | A | * | 4/1998 | Weber-Unger | 450/155 |
| 5,787,512 | A | | 8/1998 | Knox | |
| 5,833,638 | A | | 11/1998 | Nelson | |
| 5,897,423 | A | | 4/1999 | Rosenberg | |
| 5,902,170 | A | * | 5/1999 | Ganz | 450/94 |
| 5,913,410 | A | | 6/1999 | Tsuchiya | |
| 5,915,531 | A | * | 6/1999 | Hilpert et al. | 2/69 |
| 5,946,730 | A | | 9/1999 | Blair | |
| 5,956,765 | A | | 9/1999 | Chin | |
| 5,970,526 | A | | 10/1999 | Weathers | |
| 6,000,062 | A | * | 12/1999 | Trakh | 2/171 |
| 6,048,253 | A | | 4/2000 | Larsen | |
| 6,054,002 | A | | 4/2000 | Griesbach, III | |
| 6,061,832 | A | * | 5/2000 | Morrison, Jr. | 2/78.1 |
| 6,062,946 | A | * | 5/2000 | Rosenberg | 450/155 |
| 6,071,175 | A | | 6/2000 | Working, III | |
| D427,748 | S | | 7/2000 | Shackelford | |
| 6,085,356 | A | | 7/2000 | Redmond, Sr. | |
| 6,146,240 | A | * | 11/2000 | Morris | 450/97 |
| 6,219,848 | B1 | | 4/2001 | Russell | |
| 6,276,175 | B1 | * | 8/2001 | Browder, Jr. | 66/171 |
| 6,286,152 | B1 | | 9/2001 | Mooneyhan et al. | |
| 6,292,950 | B1 | | 9/2001 | Mentone | |
| 6,308,338 | B1 | | 10/2001 | Caldwell | |
| 6,309,369 | B1 | * | 10/2001 | Lebovic | 602/75 |
| 6,322,529 | B1 | | 11/2001 | Chung | |
| 6,620,026 | B1 | * | 9/2003 | Guilani et al. | 450/155 |
| 6,640,342 | B2 | | 11/2003 | Dixon | |
| 6,672,311 | B2 | | 1/2004 | Rindfleish | |
| 6,704,942 | B2 | * | 3/2004 | Lazarian | 2/409 |
| 6,739,158 | B2 | * | 5/2004 | Sciacca | 66/8 |
| 6,854,132 | B1 | * | 2/2005 | Polzin | 2/104 |
| 7,181,775 | B2 | * | 2/2007 | Carney | 2/311 |
| D552,328 | S | * | 10/2007 | Smith et al. | D2/742 |
| 40,269 | A1 | * | 1/2010 | Levac et al. | 2/108 |
| 7,676,852 | B1 | * | 3/2010 | Carney | 2/311 |
| 7,814,575 | B2 | | 10/2010 | Hendrickson et al. | |
| 7,900,276 | B2 | * | 3/2011 | Hendrickson et al. | 2/237 |
| D644,412 | S | * | 9/2011 | Reuther | D2/714 |
| 8,191,177 | B1 | | 6/2012 | Carney | |
| 2002/0002405 | A1 | * | 1/2002 | Janusson et al. | 623/36 |
| 2002/0108164 | A1 | | 8/2002 | Dixon | |
| 2004/0049834 | A1 | | 3/2004 | Stangle et al. | |
| 2004/0163159 | A1 | * | 8/2004 | Edwards et al. | 2/338 |
| 2004/0210987 | A1 | * | 10/2004 | Carney | 2/236 |
| 2005/0014451 | A1 | * | 1/2005 | Wicks | 450/155 |
| 2005/0027219 | A1 | * | 2/2005 | Schultze et al. | 602/3 |
| 2005/0115281 | A1 | * | 6/2005 | Mitchell et al. | 66/176 |
| 2006/0010571 | A1 | * | 1/2006 | Oakley | 2/227 |
| 2007/0118062 | A1 | * | 5/2007 | Fleck | 602/75 |
| 2007/0186325 | A1 | * | 8/2007 | Torrent Lopez et al. | 2/69 |
| 2008/0172769 | A1 | | 7/2008 | Herget | |
| 2009/0049583 | A1 | * | 2/2009 | Stones | 2/221 |
| 2010/0000004 | A1 | | 1/2010 | Levac et al. | |
| 2010/0235965 | A1 | | 9/2010 | Frandsen et al. | |
| 2011/0059678 | A1 | * | 3/2011 | Agassi et al. | 450/154 |
| 2011/0061147 | A1 | * | 3/2011 | Welfeld | 2/237 |
| 2011/0230119 | A1 | * | 9/2011 | Thompson | 450/10 |

FOREIGN PATENT DOCUMENTS

| | | | |
|---|---|---|---|
| AU | 2000-55047 | | 4/2001 |
| EP | 1 031 292 | A2 | 8/2000 |
| JP | 1148802 | | 6/1989 |
| JP | 01148802 | A | 6/1989 |
| JP | 8089521 | | 4/1996 |
| JP | 10266002 | | 10/1998 |
| JP | 2002088518 | | 3/2002 |
| JP | 2002317311 | | 10/2002 |
| NZ | 337903 | | 4/2002 |

OTHER PUBLICATIONS

New York Observer, the (NY), Apr. 12, 1999; p. 26; Struggling for a Fashion-Forward Pregnancy.*

KIABI website; Bandeau mater, webarchive capture, copyright KABI 2001; www.kiabi.com.*

KIABI website (translation); maternity belt; www.kiabi.com.*

Plaintiff Ingrid Carney and Ingrid & Isabel, Inc.'S Opening Claim Construction Brief, *Carney et al.* v. *Mothers Work, Inc.* (N.D. Cal. C07-1153 JCS)(Jan. 18, 2008).

Defendant Mothers Work, Inc.'S Preliminary Invalidity Contentions (Patent L.R. 3-3 and 3-4), *Carney et al*. v. *Mothers Work, Inc*. (N.D. Cal. C07-1153 JCS)(Sep. 21,2007).
Declaration of Gregory R. Stangle (w/ Exhibits A-M)(May 31, 2007).
Deposition of Gregory Stangle, *Carney et al*. v. *Mothers Work, Inc*. (N.D. Cal. C07-1153 JCS)(Sep. 13, 2007).
Kershaw, Sydney Morning Herald, "Pregnancy Gives Birth to Real 'Belter' of a Product" (Mar. 16, 2002).
Millard, The Independent (London), "Style: Big News from the Front" (Apr. 25, 1997).
Brinley, "Maternity Style: How to Look Your Best When You're at Your Biggest", S1. Martin's Press (1985).
Sutherland, "Pregnant and Chic", Workman Publishing (1989).
Fendel, "Waiting in Style", Acropolis Books, Ltd. (1983).
Serota et al., "Pregnancy Chic: The Fashion Survival Guide", Villard Books (1998).
Callan, "The Thames and Hudson Dictionary of Fashion and Fashion Designers" (belt), Thames & Hudson, Inc. (1998).
Tortora, "Encyclopedia of Accessories" (belts), Fairchild Publications, Inc. (2003).
Belly Belt, Maternity Wear Solution, Australia.
Counterclaimant Baby Be Mine, LLC's Responsive Claim Construction Brief, *Ingrid & Isabel, Inc*. v. *Baby Be Mine, LLC* (N.D. Cal. CV-08-02554 JCS)(Feb. 25, 2009).
Mothers Work's Responsive Claim Construction Brief, *Ingrid Carney* v. *Mothers Work, Inc*. (N.D. Cal. C07 1153 JCS) (Feb. 1, 2008).
www.inthe80s.com, Units description, Jun. 2, 2002.
www.netrags.com|fashionshow.htm, Multiples photos and descriptions, Mar. 6, 2000.
Happers Bazaar, Nov. 1952, p. 98, Cinch Belts, Dorothy Huges.
http://www.mytiesarongs.com/tubetops.htm, My Ties, Cotton stretch tube top, Mar. 2001.
The Notion and Novely Review, Aug. 1936, Belts, Make the Silhouette.
Ingrid & Isabel, Inc.'s Opening Claim Construction Brief, *Ingrid & Isabel, Inc*. v. *Baby Be Mine, LLC* (N.D. Cal. C08-02554 JCS)(Dec. 22, 2008).
Ingrid & Isabel, Inc.'s Reply Brief in Support of Claim Construction, *Ingrid & Isabel, Inc*. v. *Baby Be Mine, LLC* (N.D. Cal. C08-02554 JCS)(Mar. 2, 2009).
Plaintiffs Reply Brief on Claim Construction, *Ingrid Carney and Ingrid & Isabel, Inc*. v. *Mothers Work, Inc*. (N.D. Cal. C07-1153 JCS)(Feb. 8, 2008).
Stipulated Order and Consent Judgment, *Ingrid Carney and Ingrid & Isabel, Inc*. v. *Mothers Work, Inc*. (N.D. Cal. C07-1153 JCS)(May 16, 2008).
Claim Construction Order, *Ingrid & Isabel, Inc*. v. *Baby Be Mine, LLC* (N.D. Cal. C08-2554 JCS)(Apr. 3, 2009).

* cited by examiner

200

| Brand | Size | Top Width | Bottom Width | Center Front Height | Content | Weight (gm/m²) |
|---|---|---|---|---|---|---|
| Band A | 0 | 11.5 | 11.5 | 10 | 84% Nylon 16% Spandex | 270-300 |
| | 1 | 12.5 | 12.5 | 11 | 84% Nylon 16% Spandex | 270-300 |
| | 1a | 13.5 | 13.5 | 12.5 | 84% Nylon 16% Spandex | 270-300 |
| | 2 | 14.5 | 14.5 | 11.25 | 84% Nylon 16% Spandex | 270-300 |
| | 3 | 16.5 | 16.5 | 11.5 | 84% Nylon 16% Spandex | 270-300 |
| | 4 | 17 | 17 | 11.75 | 84% Nylon 16% Spandex | 270-300 |
| Band B | S/M | 11.25 | 11.25 | 11 | 79% Nylon 21% Spandex | 210-240 |
| | M/L | 13 | 13 | 11.5 | 79% Nylon 21% Spandex | 210-240 |
| | L/XL | 15 | 15 | 12 | 79% Nylon 21% Spandex | 210-240 |
| | S/M - a | 12.25 | 12.25 | 11.25 | 79% Nylon 21% Spandex | 210-240 |
| | M/L - a | 14 | 14 | 11.75 | 79% Nylon 21% Spandex | 210-240 |
| Band C | 1 | 12.5 | 12.5 | 11 | 95% Organic Cotton 5% Spandex | 300-330 |
| | 2 | 14.5 | 14.5 | 11.25 | 95% Organic Cotton 5% Spandex | 300-330 |
| | 3/4 | 17 | 17 | 11.5 | 95% Organic Cotton 5% Spandex | 300-330 |
| Band D | 1 | 11.75 | 11.75 | 12.5 | 82% Nylon 18% Spandex | 240-270 |
| | 1a | 12.75 | 12.75 | 12.5 | 82% Nylon 18% Spandex | 240-270 |
| | 2 | 13.75 | 13.75 | 12.75 | 82% Nylon 18% Spandex | 240-270 |
| | 2a | 14.75 | 14.75 | 12.75 | 82% Nylon 18% Spandex | 240-270 |
| | 3 | 15.75 | 15.75 | 13 | 82% Nylon 18% Spandex | 240-270 |
| Band E | one size | 12.75 | 12.5 | 12.75 | 89% Nylon 11% Spandex | 285-315 |
| Band F | one size | 12.5 | 12.25 | 11 | 85% Nylon 15% Spandex | 210-240 |
| Band G | one size | 11.75 | 11.75 | 11 | 90% Nylon 10% Spandex | 260-290 |
| Band H | one size | 11.25 | 11.25 | 14 | 93% Nylon 7% Spandex | – |
| Band I | --- | --- | --- | --- | 95% Cotton 5% Spandex | --- |
| Band J | one size | 8.5 | 11.25 | 11 | 79% Nylon 21% Spandex | 210-240 |
| Band K | one size | 11.25 | 11.25 | 9 | 79% Nylon 21% Spandex | 210-240 |
| Band L | one size | 11.25 | 11.25 | 11 | 79% Nylon 21% Spandex | 190-210 |
| Band M | 1 | 12.5 | 12.5 | 11 | 87% Nylon 13% Spandex | 230-260 |

FIG. 2

MATERNITY GARMENT

CROSS-REFERENCE TO RELATED APPLICATIONS

This application is a continuation-in-part and claims the priority benefit of U.S. patent application Ser. No. 12/697,144 filed Jan. 29, 2010, now U.S. Pat. No. 8,191,177, which is a continuation and claims the priority benefit of U.S. patent application Ser. No. 11/435,492 filed May 16, 2006, now U.S. Pat. No. 7,676,852, which is a continuation and claims the priority benefit of U.S. patent application Ser. No. 10/423,224, filed Apr. 25, 2003, now U.S. Pat. No. 7,181,775. The disclosures of the aforementioned applications are incorporated herein by reference.

BACKGROUND OF THE INVENTION

1. Field of the Invention

This invention generally concerns maternity apparel, and specifically relates to a stretchable garment that can be worn in such a way as to allow pants, shorts, or a skirt to be left open at the waist. Alternatively, the garment may allow a woman to wear oversized maternity pants or skirts without those pants or skirt falling off or appearing too large, bulky, or awkward during early pregnancy or when her belly is not yet big enough to fill the maternity wear. In both instances, the garment accommodates changes in the shape of the body during pregnancy and afterwards.

2. Description of the Related Art

The shape of a woman's body changes dramatically during pregnancy, and even after pregnancy, can require considerable time and effort to return to normal. In particular, the pregnant woman's belly goes through several phases, expanding and retracting over a period of time which is relatively short in comparison to non-pregnancy related weight gains and losses. At some point during pregnancy and for a given period post-partum, the pregnant woman is unable to wear her normal clothes, particularly pants and skirts, which can no longer be fastened. Specialized maternity clothes are available but even with these specialized items, the continued changes in the shape of the pregnant woman often result in constant challenges with any clothing. While the maternity apparel industry has responded to the extent it can by developing new designs intended to expand and retract with the pregnant and post-pregnancy changes, the results are often unsatisfactory and stylistically unpleasing. Despite the efforts of maternity apparel companies, the range of sizes of at which women begin and end their pregnancies is so vast that creating garments that can last throughout pregnancy is simply too challenging.

Noticeable changes generally start in early pregnancy when a woman's belly begins to show thereby causing her pants and skirts to feel tighter around the waist. This stage is called transition. The woman may try rudimentary solutions to fasten clothes without the normal closure at the waist, or may buy pants and skirts one or several sizes larger than her pre-pregnancy size for this temporary phase, but such clothing is nonetheless ill-fitting. On top of this, the continued tumescence over the following weeks will obviate these temporary measures. There are few practical solutions for this transition stage.

At the end of the transition stage, the pregnant woman begins wearing maternity clothes. However, it is often the case that her belly cannot fill most maternity garments (18-26 week range). Maternity apparel is generally manufactured for an average-sized woman in her seventh month of pregnancy (about 30 weeks). Typically a panel garment made for bottom-half maternity wear remains too large until the woman is well into her second trimester, or entering her third trimester (22-32 week range). Available maternity clothing is usually too loose at this stage, and the pregnant woman typically wears excess fabric around her belly, which appears bulky and unattractive underneath her blouses, sweaters and T-shirts. Or the woman may purchase maternity wear that fits her early-staged belly, but will be outgrown as her body increases in size entering her late second trimester and third trimester.

Only in about the 30-40 week range does the body typically fill and wear well the available maternity clothing. However, in this stage when her belly is round, her body has changed its shape and her belly out-balances her back. During this period, her maternity pants often fall while walking as her pant panels slide down from a large belly, or her under-the-belly pants, skirts, or shorts slip down in back as a result of her belly pushing front waistbands down toward her pelvic bone. Hence, the pregnant woman spends an inordinate amount of her time pulling her pants up.

After delivery, the woman's body continues its metamorphosis as it reshapes into its normal size over weeks or months. Finding clothes to fit properly requires considerable creativity. At most stages, the maternity clothing, oversized regular clothing, or the normal size regular clothing will be ill-fitting, either too tight or too loose, too bulky, and/or awkward and unattractive.

In the prior art, these problems have been addressed in various ways. U.S. Pat. No. 4,580,298 shows a waistband extender allowing the pants to be worn open, but with an elastic strip connecting to the waistband at the top so as to allow an expanded size at the waist; U.S. Pat. No. 6,085,356 is similar. U.S. Pat. No. 2,787,792 shows a maternity skirt with an elastic insert in the area needing additional room; U.S. Pat. No. 4,280,229 is somewhat similar. U.S. Pat. No. 5,902,170 merely shows a band worn as an undergarment, to give the body a more pleasing shape. U.S. Pat. Nos. 3,431,562 and 3,089,149 show skirts that can be re-shaped with insert panels to provide for a larger waist.

Similar to the devices in some of the above patents is the product "Belly Belt," which is made in Australia and marketed online by Motherhood Maternity. The product is a simple fabric panel about seven inches wide, with a belt channel formed along the top edge to receive an included elastic belt. The pants or skirt are worn open, with the panel tucked behind to cover the open area and the elastic belt secured by button and buttonhole connected to existing buttonhole and button the pants or skirt.

Nothing in the prior art shows or suggests the approach of the present invention by which the pregnant woman's normal clothes can be worn, throughout much of the pregnancy and postpartum, in a comfortable and attractive manner.

SUMMARY OF THE INVENTION

During pregnancy, in one embodiment of the invention, a woman wears her pants (the term pants includes shorts) or skirt unfastened at the top, to the degree needed, and wears a stretchable generally cylindrical garment, similar to a "tube top", over the waist in such a way as to overlap the unfastened top end of the pants or skirt. In addition to covering the unfastened upper area of the lower garment, the band of the invention holds the pants or skirt in place on the body. A shirt or blouse can be worn extending over the band. The result is an assembled and neat appearance which, although not hiding the fact of pregnancy, avoids ill-fitting clothing and a bulky, awkward, or unattractive appearance. In another aspect of the invention a pregnant woman wears the band garment over either an oversized maternity garment (pants or skirt) or maternity garments with panels, covering and pressing down excess fabric to eliminate bulkiness while retaining the bottom garment in place, or over maternity pants that are being pushed down due to an oversized belly.

The invention is principally embodied in a method for accommodating changes in the shape of a woman during pregnancy without the need for a series of different-sized maternity clothes. This method, in one form, includes providing a band of flexible, stretchable material, which may be generally cylindrical in shape and in a size so as to be expanded and stretched to be worn around a pregnant woman's torso approximately at the waist. The pregnant woman wears the elastic band over pants or a skirt which has become too tight to accommodate the swelling of the belly during pregnancy, by wearing the pants or skirt unfastened and stretching and placing the elastic band over an upper portion and upper edge of the pants or skirt. In addition, the elastic band may be worn over oversized maternity clothes or maternity garments with panels which are too large, loose, or baggy to accommodate the swelling of pregnancy or postpartum or which the woman's pregnant belly does not yet fill. The band, again, is worn over an upper portion and upper edge of the pants or skirt. The band may be worn over maternity waistbands that have fallen around a pregnant woman's hips due to an oversized belly.

The method preferably may include wearing the band such that a portion of the height of the band resides over the pants or skirt, while an upper portion of the band's height extends above the upper edge of the pants or skirt and engages against the torso. In addition, if desired the woman may wear the band such that it covers the bottom or tail end of a top, such as a shirt or blouse, although normally the top garment would extend down over the band.

The elastic band, if desired, may be worn as a single layer residing over the pants or skirt, or folded in half as a double layer, providing an additional layer to further conceal bulky and cumbersome fabric, increasing tension slightly. Wearing the elastic band as a double layer increases the ability of the band to hold up clothing (e.g., pants or skirts) that require additional strength.

The band garment of the invention preferably is formed of knit fabric which, with the elastic in the fabric, comfortably hugs a woman's lower abdomen, flattening and shaping any fabric underneath, such as unfastened buttons and zippers or excess fabric from large, oversized, drooping, loose, or baggy maternity wear that the woman does not fill. The woman can wear her normal pre-pregnancy clothes longer and maternity clothes sooner, as the band garment transforms bulky and cumbersome fabric or ill-fitting clothing or maternity clothing to appear as well-fitted apparel. The result is a shapely and smooth belly surface that is both comfortable and attractive. Wearing the band garment the woman can wear form-fitting tops, shirts and sweaters without the bulky fabric of unfastened closures or excess maternity fabric bulging over the belly and through the tops. After pregnancy, a new mother can use the band garment to transition from maternity wear to normal, pre-pregnancy clothes as the body reshapes itself. If the woman's untucked top rises to expose her belly, only the band garment will be visible, appearing as part of the clothing worn.

DESCRIPTION OF THE DRAWINGS

FIG. 2 is a table listing exemplary band garments.

DETAILED DESCRIPTION

Figure 1:
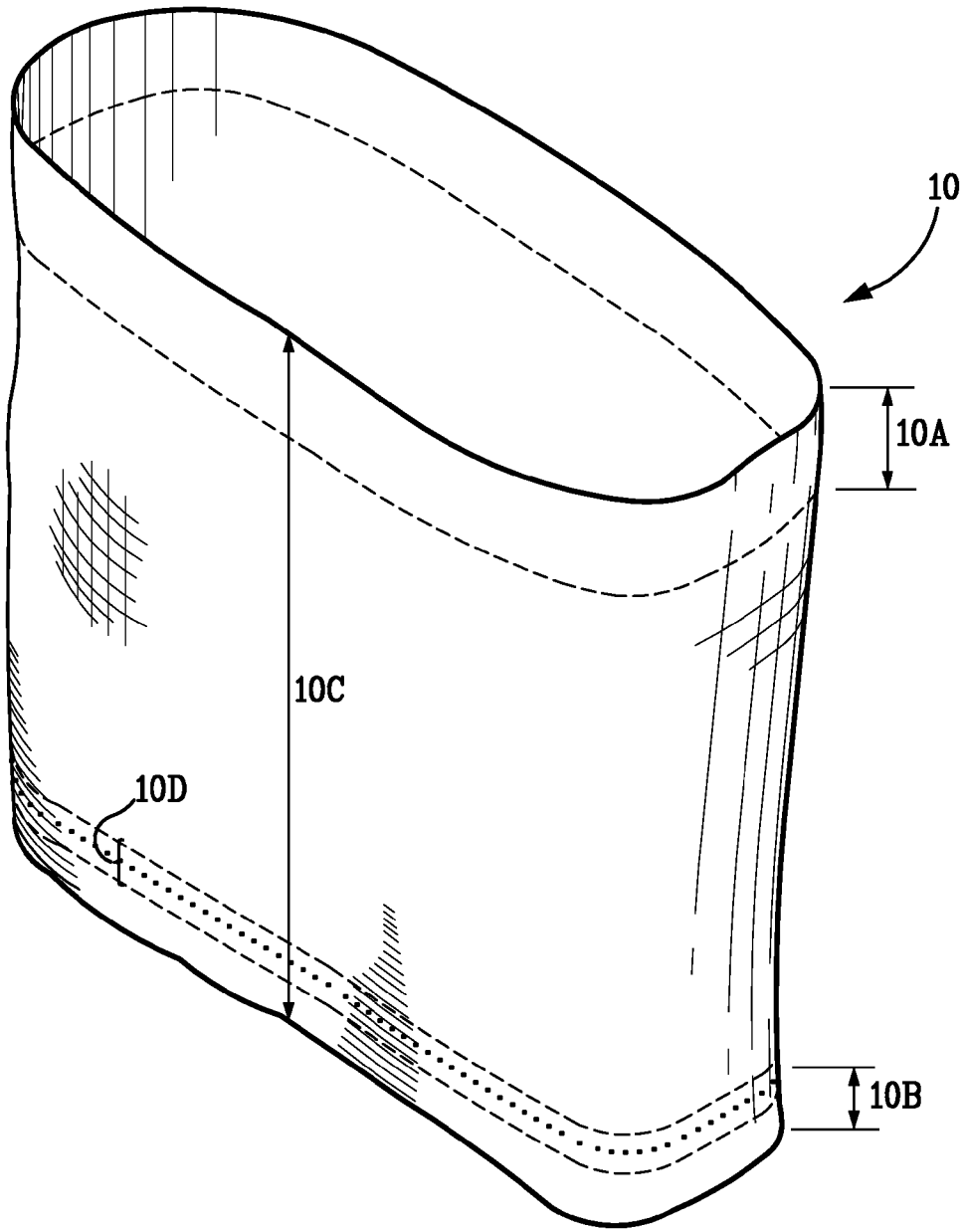
FIG. 1 is a perspective view showing a band garment for pregnant women.

In the drawings, FIG. 1 shows a band garment 10. In one embodiment, the band garment 10 is manufactured from a flexible, stretchable material capable of being expanded and stretched to be firmly but comfortably worn around a woman during pregnancy or postpartum approximately at the waist. The band garment 10 may range from about five inches (when folded over on itself) to nineteen inches in height. The band garment 10 is preferably about six to twelve inches in height, more preferably about ten to twelve inches, and of a circumference which will accommodate a pregnant woman of a designated size range, the circumference preferably being between 20 and 30 inches (in.). In one embodiment, the circumference of band garment 10 is between 22 and 34 in. In another embodiment, the circumference of the band garment 10 is between 17 and 34 in. In one embodiment, the band garment 10 is about 10 to 13 in. in height.

As illustrated in FIG. 1, the band garment 10 may have a top width 10A ranging from 8¼ in. to 17 in. and a bottom width 10B ranging from 8¼ in. to 17 in. The top width 10A and bottom width 10B may be defined by a seam, a hemline, a fold in the fabric of the band garment, a change in pattern, design or color of the band garment, or by any other means. The top width 10A and/or bottom width 10B, in some embodiments, may be seamless. The band garment 10 may also be of a uniform circumference. The band garment 10 may have a center front height 10C, as shown in FIG. 1, ranging from about 9 in. to 19 in. The center front height may be defined as the total height of the band garment 10. For example, the center front height may be the distance from the bottom of the bottom width 10B to the top of the top width 10A. The band garment 10 may also include a silicone strip or coating 10D applied to a bottom area (e.g., interior base or hem) of the garment. The silicone strip or coating 10D may be applied to help the garment adhere or stick to the body of the woman and/or prevent the garment from moving during use. The silicone strip or coating 10D may be applied to the garment using any technique known in the art such as knife coating, dip/immersion coating, rotogravure coating, extrusion, or spraying. The silicone strip or coating 10D may have a height of about ¼ inch to 1 inch.

The flexible, stretchable material of the band garment 10 may have a weight (also referred to as fabric density) ranging from 190 grams/square meter to 330 grams/square meter ($gm/m^2$). FIG. 2 shows table 200 which identifies, in chart form, weights in $gm/m^2$ for a number of exemplary embodiments. The band garment 10 may be manufactured from a piece of circularly knitted fabric such as a single knit or double knit. In one embodiment, the band garment 10 is manufactured using an electronic circular knitting machine or electronic warp knitting machine for seamless products, such as the single jersey, double jersey, or warp seamless machines produced by Santoni S.p.A. of Brescia, Italy. The knitting machine may have a cylinder having various shapes and properties. The knitting machine, for example, may have a cylinder size ranging from about 12 inches to 17 inches. The cylinder may also allow the use of different fabrics, yarn types, needles, and knitting structures.

The band garment 10 is of stretchable material, and can be designed such that one size fits most users, although two or more different sizes can be provided if desired, for different sizes of women. Sizes may be designated by numbers or letters. For example, as shown in table 200, the garment may be available in different sizes, such as sizes 0-4, wherein size 0 is the smallest available garment with the smallest measurement and size 4 is the largest garment with the largest measurement. Alternatively, as shown in table 200, sizes may be designated by letters such as "S/M" indicating a small to medium sized garment, "M/L" indicating a medium to large sized garment, and "L/XL" indicating a large to extra large sized garment. It is intended that a band garment 10 of a single size will fit a particular pregnant woman throughout the period of time when she cannot wear her normal clothing, or is too small for maternity wear.

In one embodiment the band garment 10 is of knit fabric, in basic colors typical of bottom-half clothing today such as black, khaki, denim-color blue, and white. The band garment 10 can also be made in various and seasonal patterns and colors if desired. The band garment 10 may also be textured or adorned with any decoration known in the art such as lace, beads, or decorative stitching.

The knit fabric may be any knit fabric known in the art such as double knit fabric, single knit fabric, baby rib knit, interlock knit, fleece, stretch velvet, or textured novelty knit. In one embodiment, the knit fabric is jersey fabric. The garment may be seamless (or it can be seamed) and of a stretchable, knit nylon/spandex (elastane) blend. The knit fabric nylon/spandex blend may include 75-95% nylon and 5-25% spandex. For example, the nylon/spandex blend may include 79% nylon and 21% spandex, 80% nylon and 20% spandex, 82% nylon and 18% spandex, 84% nylon and 16% spandex, 85% nylon and 15% spandex, 87% nylon and 13% spandex, 89% nylon and 11% spandex, 90% nylon and 10% spandex, 93% nylon and 7% spandex, or 95% nylon and 5% spandex. In another embodiment, the band garment 10 is made of a knit fabric such as a cotton spandex blend or an organic cotton spandex blend. For example, the knit fabric cotton blend may be 90% cotton and 10% spandex, 95% cotton and 5% spandex, or 95% organic cotton and 5% spandex. In other embodiments, the band garment 10 may be made of other suitable fabrics known in the art such as polyester, nylon, lyocel, rayon, polyamide, or viscose.

FIG. 2 is a table listing exemplary band garments in accordance with some embodiments of the invention. The table 200 in FIG. 2 lists various bands A-M. The bands in table 200 may be any color (e.g., black, khaki, denim-color blue, or white) and may be seamless or have a seam. As shown in table 200, a band may be available in one size (e.g., bands E-H and J-L) or come in various sizes (e.g., bands A-D and M). Table 200 also shows exemplary band garment content (e.g., blends), top widths (in inches), bottom widths (in inches), and center front heights (in inches) for each of the various bands A-M. Exemplary weights (in $gm/m^2$) for each band are also shown in table 200.

Figure 3:
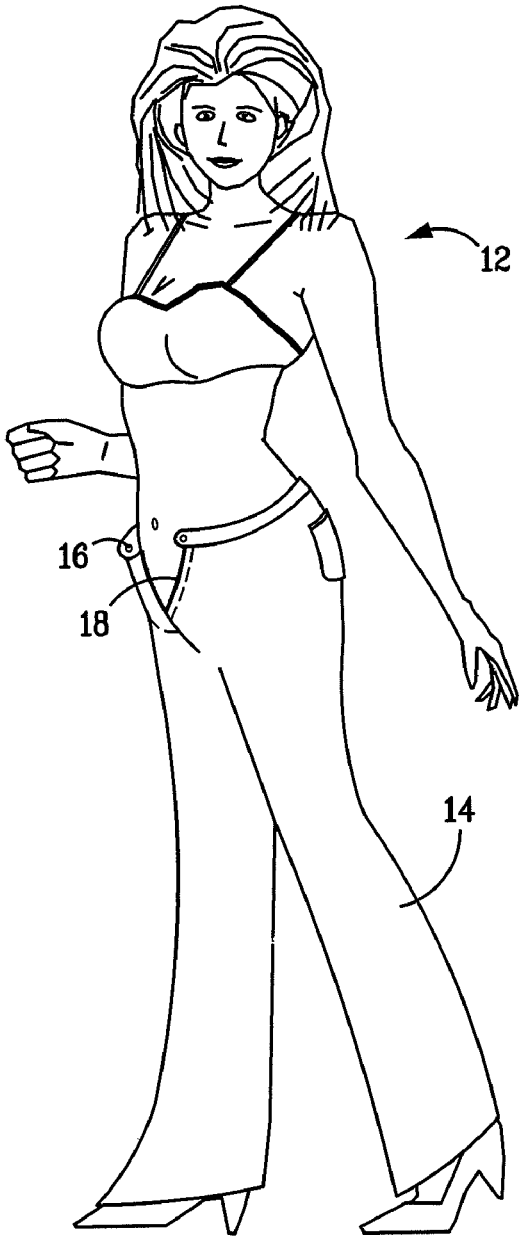
FIG. 3 is a view showing a pregnant woman wearing pre-pregnancy pants, unfastened so as to accommodate the enlarged shape of the belly.

FIG. 3 shows a pregnant woman 12 who is wearing her normal pre-pregnancy pants 14, but is unable to comfortably fasten the button 16 and zipper 18 at the top of the pants. However, the portion below the belly still fits comfortably, and the pants 14 fit reasonably well with the fastenings left open, as shown.

Figure 4:
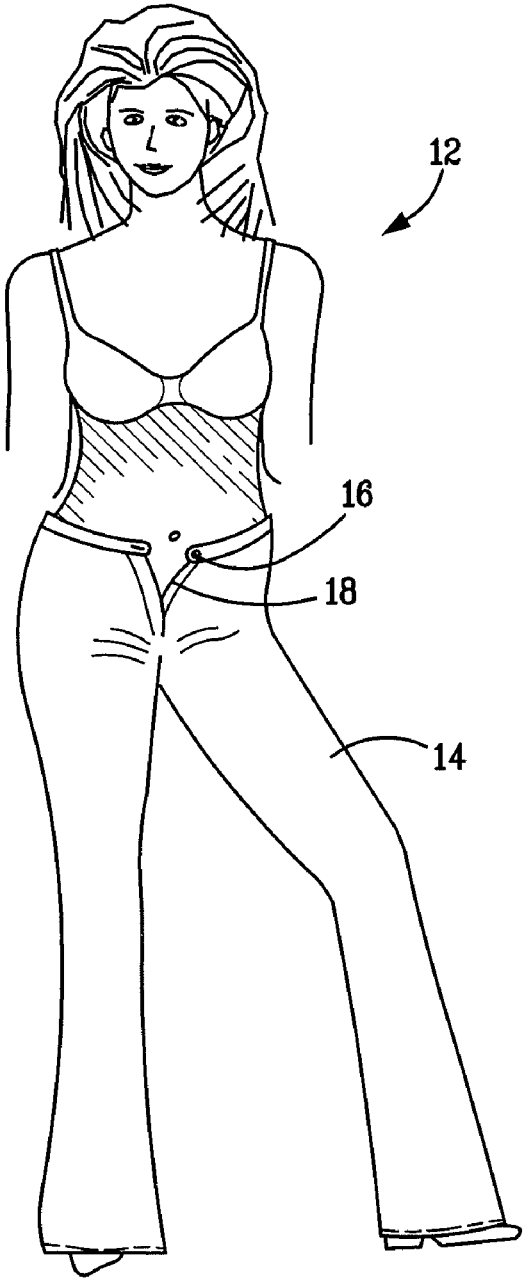
FIG. 4 is a frontal view of what is shown in FIG. 3.

FIG. 4 is a frontal view of the same pregnant woman 12, with the pants 14 shown opened as in FIG. 3. This, of course, is not a complete solution to her problem, because the pants need some means of being retained in position and because, if she simply wears a top sized to extend down over the open top of the pants, as in FIG. 5A, this appears bunched and bulky and awkward, as FIG. 5A illustrates at 20.

Figure 5:
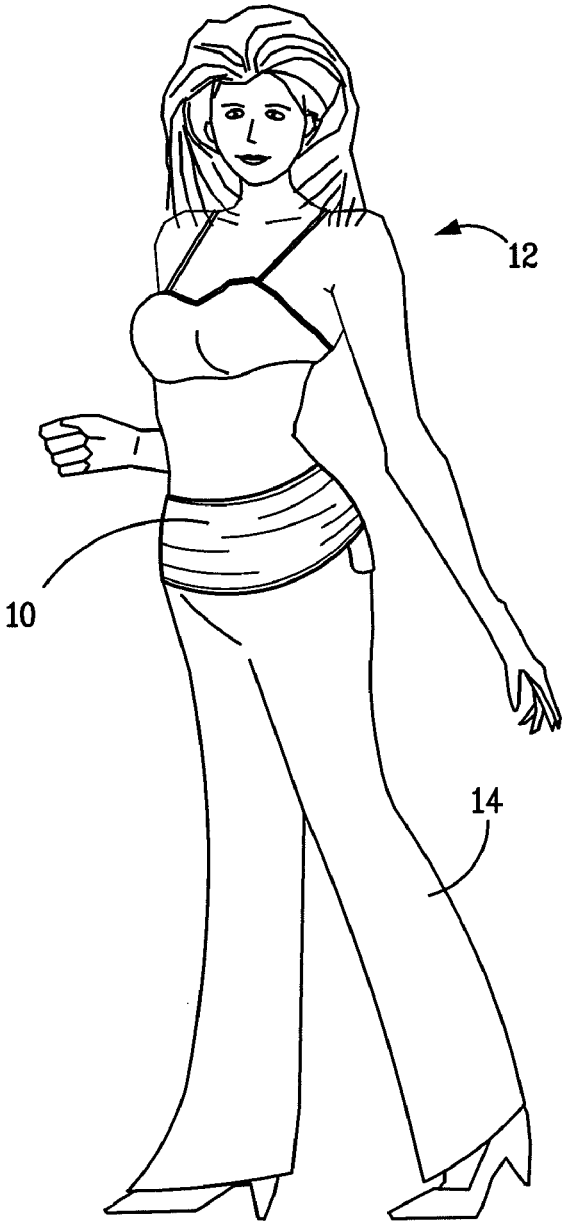
FIG. 5 is a view showing the pregnant woman wearing the band garment approximately at the waist, overlapping the unfastened pants so as to cover the open pants top and to retain the pants on the body.
Figure 5A:
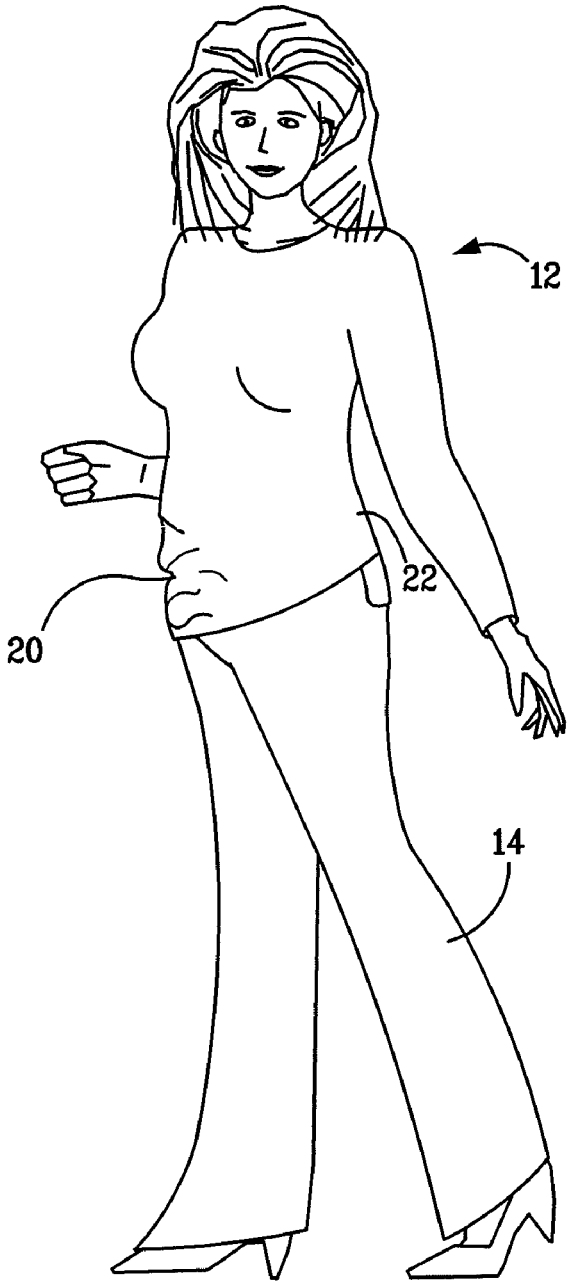
FIG. 5A is a view similar to FIG. 5, but showing the pregnant woman wearing pants as in FIGS. 3 and 4 without the band garment of the invention, with a top covering the upper end of the pants.

FIG. 5 shows the solution provided by the band garment 10. As shown, the stretchable band 10 engages somewhat firmly but comfortably over the top of the woman's skirt or pants 14 in the opened condition, holding the zipper, button and flaps closely and flatly and avoiding any bulkiness or awkward appearance.

Figure 5B:
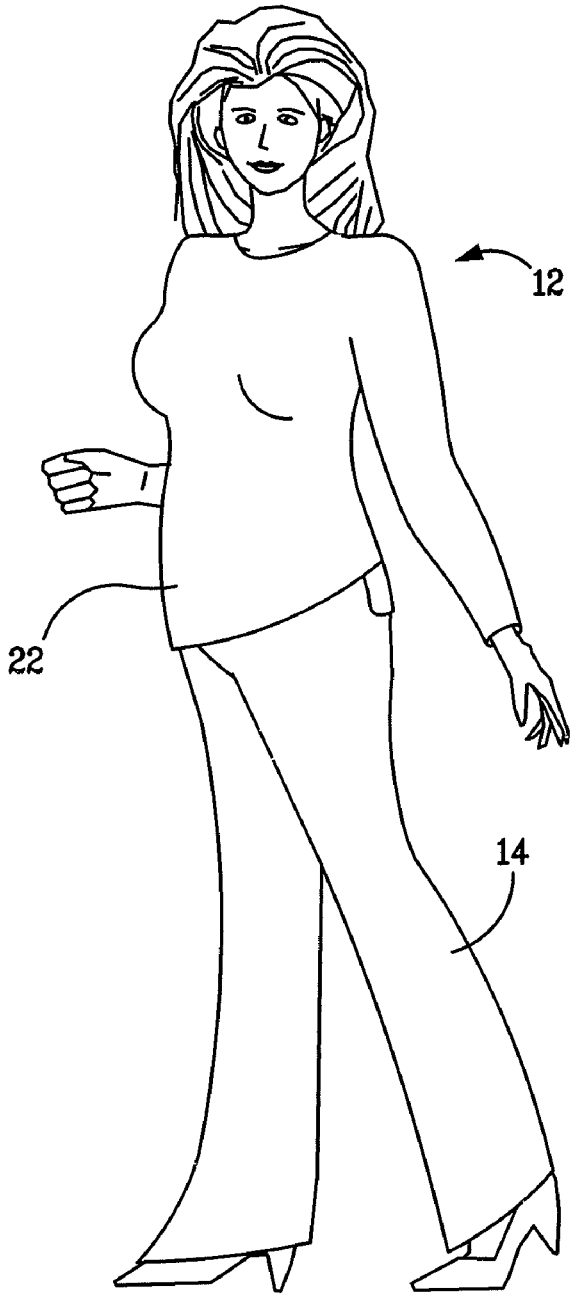
FIG. 5B is a view similar to FIG. 5 showing the pregnant woman's appearance wearing the band garment of the invention, with a top covering the band garment.
Figure 6:
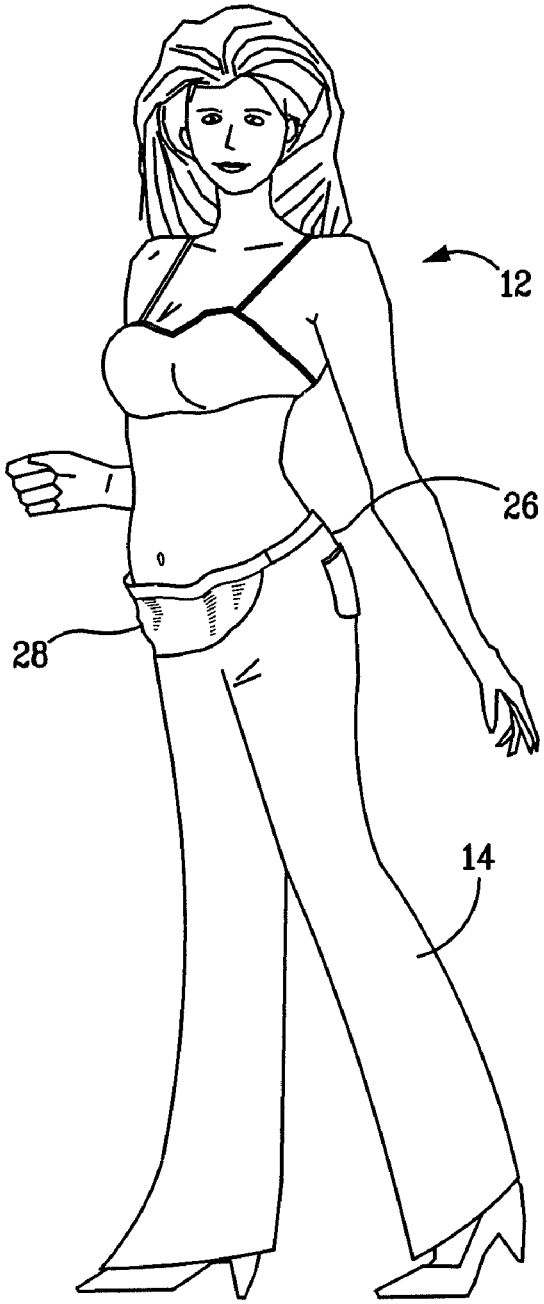
FIG. 6 is a view showing a pregnant woman wearing maternity pants, which are too large at the waist for her current condition.
Figure 7:
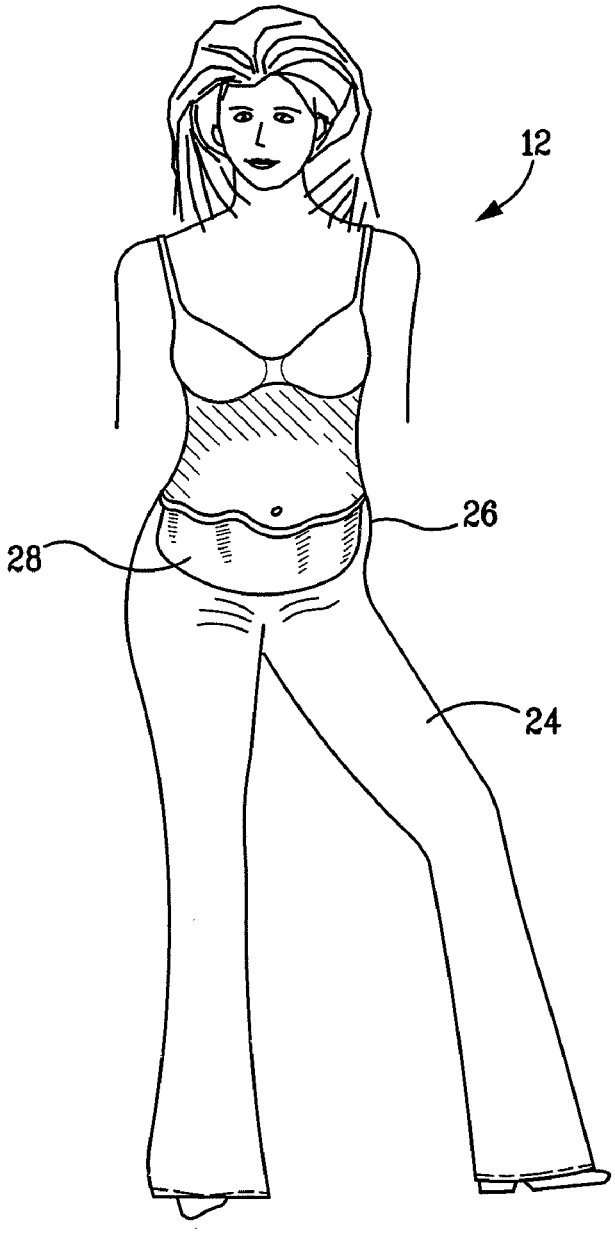
FIG. 7 is a frontal view of what is shown in FIG. 6.

FIG. 5B shows the woman 12 wearing the band garment as in FIG. 5, but with a top 22 down over the band garment and contacting the pants 14. As illustrated, the bulky and awkward appearance is eliminated.

Figure 8:
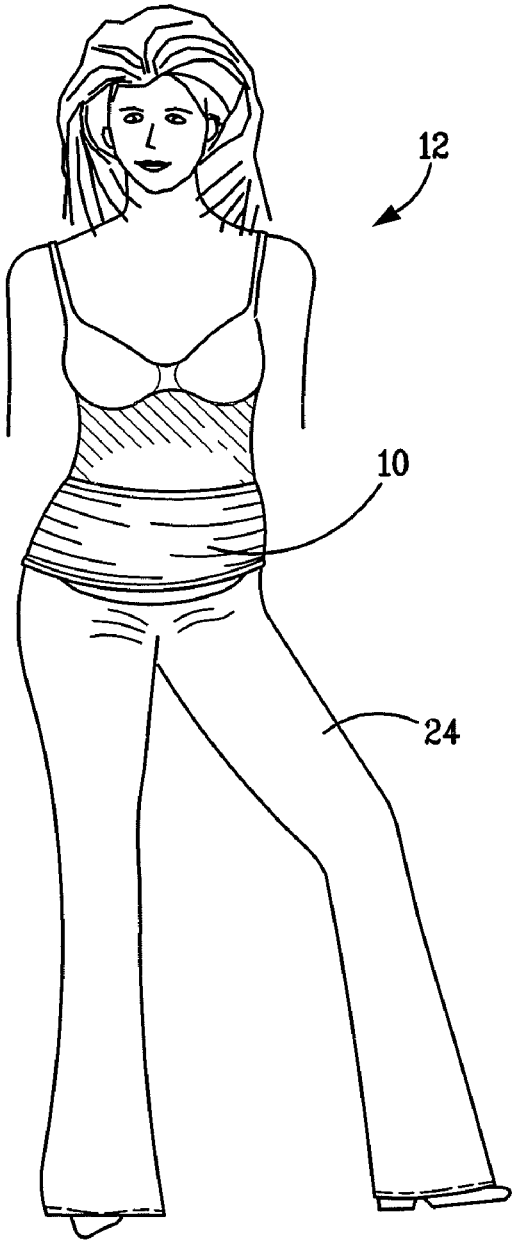
FIG. 8 is a view similar to FIG. 5, but showing a pregnant woman wearing oversized maternity clothing as in FIGS. 6 and 7, retained in position by the band garment described herein.
Figure 8A:
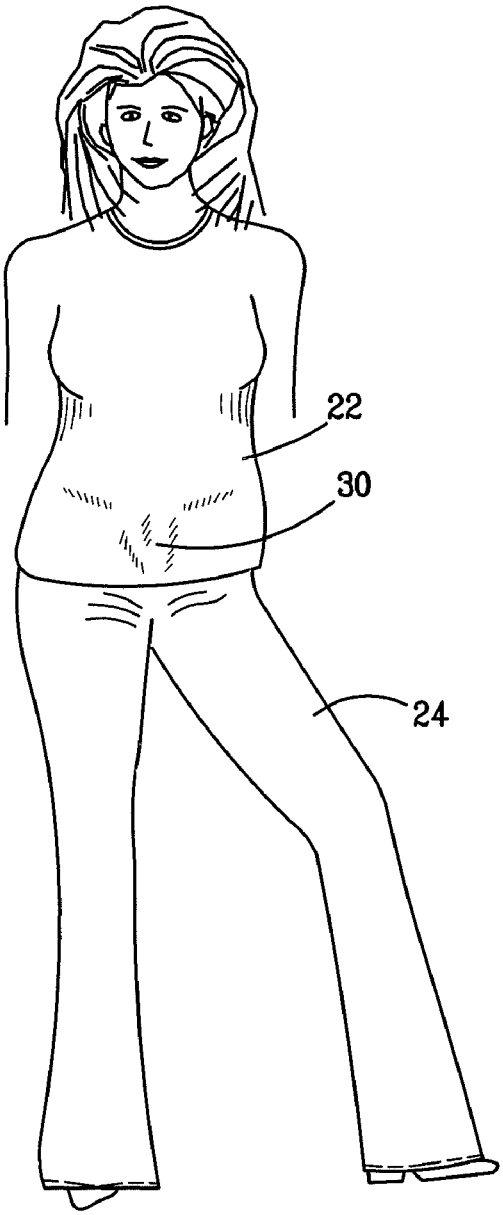
FIG. 8A is a view similar to FIG. 8 showing the pregnant woman wearing loose maternity clothing as in FIGS. 6 and 7, covered by a top, and without the band garment described herein.

FIGS. 6, 7, 8, 8A and 8B show the pregnant woman 12, at about the same stage of pregnancy as in the earlier figures, wearing maternity clothing 24 which is too large for this stage of pregnancy. The pants shown in FIG. 6 have a waist 26 which is expanded from a normal waist size commensurate with pants of this size, and may have a stretchable expansion panel in the front as shown at 28. The same maternity clothing is shown on the woman 12 in frontal view in FIG. 7. FIG. 8A shows the effect of simply wearing a top 22, i.e. a shirt or blouse, over the oversized and loose waist portion of maternity clothing 24. This gives a lumpy, bunched, awkward appearance, especially at the frontal area 30. Maternity clothing may include pants or skirts.

Figure 8B:
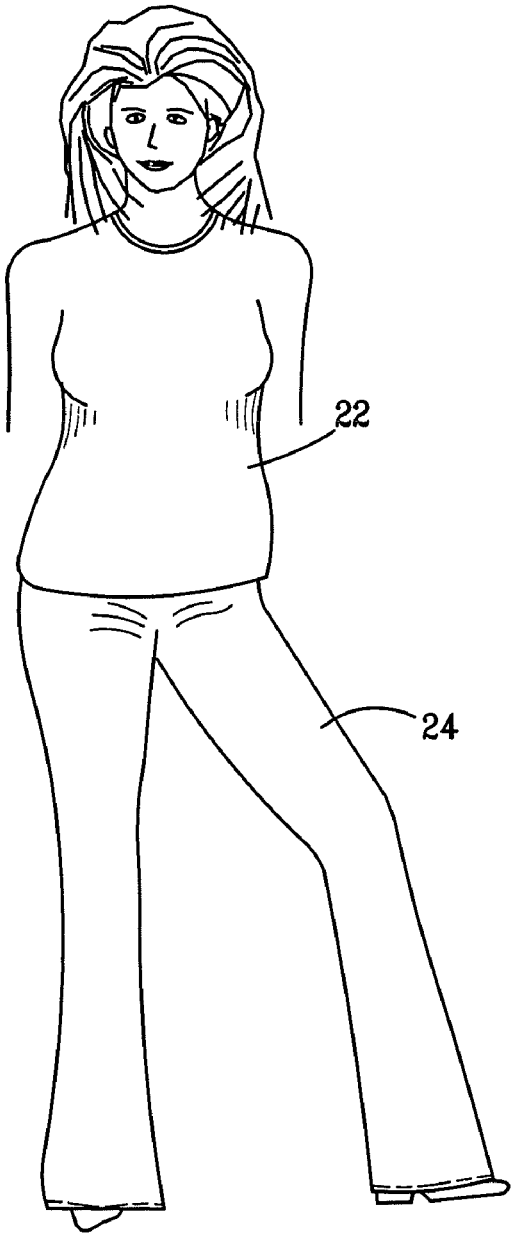
FIG. 8B is another view similar to FIG. 8, but showing a top covering the band garment described herein.

FIG. 8 shows the woman 12 wearing the same oversized maternity clothing 24, but also wearing the band garment 10 of the invention. As is the case with open-waisted pants or skirt, the band garment 10 firmly but comfortably holds the fabric closely against the woman's body and avoids any awkward appearance. FIG. 8B shows the same woman 12 wearing a top 22 down over the band garment. The result is a very neat and tidy appearance, not hiding the fact of pregnancy but giving the clothes the appearance of a very good fit and also providing for considerable further expansion of the belly.

Figure 8C:
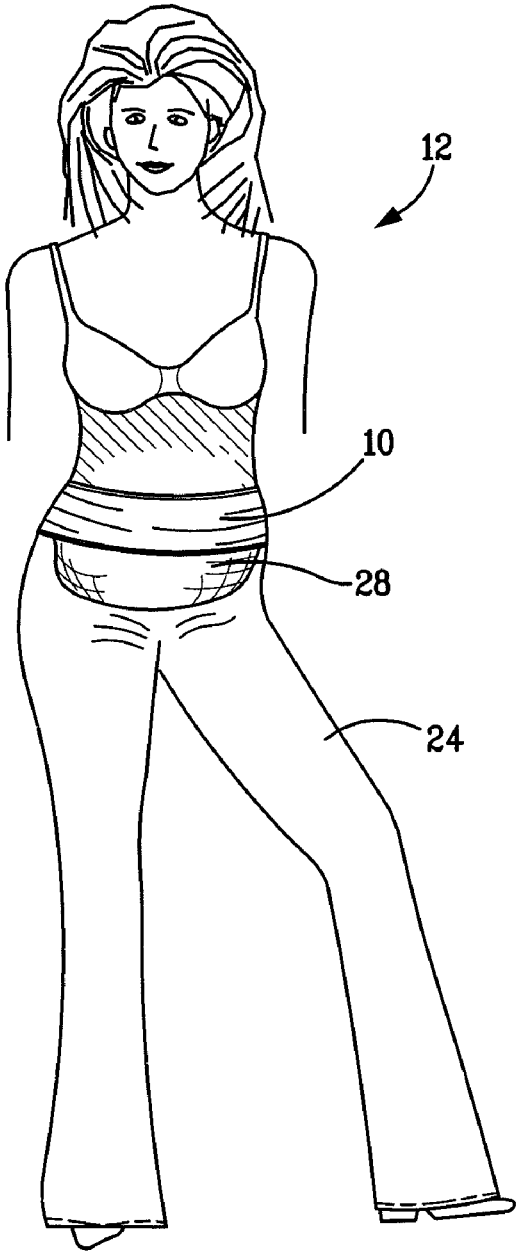
FIG. 8C is a view similar to FIG. 8, but showing the band garment folded into a doubled configuration, halving the height as worn.

FIG. 8C shows the woman 12 as in FIG. 8, but with the band garment 10 folded so as to double it in half, slightly increasing tension and providing an additional layer to help conceal excess fabric, in this case, or an unzipped upper edge of the pants or skirt, in that case. In some cases, the wearer may prefer the reduced height of the band garment.

The above described embodiments are intended to illustrate the principles of the invention, but not to limit its scope. Other embodiments and variations to these embodiments will be apparent to those skilled in the art and may be made without departing from the spirit and scope of the invention as defined in the following claims.

What is claimed is:

1. A garment comprising:

a cylindrical band of uniform circumference with a center front height of 9 in. to 16 in. and a fabric density of 190-330 gm/m$^2$, the band being formed from a knit fabric blend including 75-95% nylon and an inversely corresponding percentage of spandex, the band being expanded and stretched to be firmly but comfortably worn around the torso of a woman during pregnancy or postpartum approximately at the waist, the band comprising:

a lower portion positioned over pre-pregnancy clothes that is stretched and worn over an upper edge of pre-pregnancy clothes that have become too tight to accommodate the swelling of pregnancy or postpartum unless left unfastened when worn; and an upper portion extended above the upper edge of the pre-pregnancy clothes and engaged against the body of the woman, the upper end of the pre-pregnancy clothes held closely against the torso of the woman by the garment thereby retaining the unfastened pre-pregnancy clothes in place while providing a fitted appearance of the pre-pregnancy clothes notwithstanding the unfastened state.

2. The garment of claim 1, wherein the cylindrical band is seamless.

3. The garment of claim 1, wherein the knit fabric is jersey.

4. The garment of claim 1, wherein the knit fabric is a blend including 90% nylon and 10% spandex.

5. The garment of claim 1, wherein the knit fabric is a blend including 93% nylon and 7% spandex.

6. The garment of claim 1, wherein the knit fabric is a blend including 84% nylon and 16% spandex.

7. The garment of claim 1, wherein the cylindrical band is formed using an electronic circular knitting machine having a cylinder size ranging from 12 inches to 17 inches.

8. The garment of claim 1, wherein the cylindrical band has a top width of 8½ to 17 in.

9. The garment of claim 1, wherein the cylindrical band has a bottom width of 8½ in. to 17 in.

10. The garment of claim 1, wherein the cylindrical band includes a silicone strip applied to a bottom area of the garment.

11. The garment of claim 10, wherein the silicone strip has a height of ¼ in. to 1 in.

12. The garment of claim 1, wherein the cylindrical band is folded in half and worn as a double layer residing over the wearer's clothing.

13. The garment of claim 1, wherein the knit fabric is a blend including 82% nylon and 18% spandex.

14. The garment of claim 1, wherein the knit fabric is a blend including 79% nylon and 21% spandex.

15. A garment comprising:

a cylindrical band of uniform circumference formed from 79% nylon and 21% spandex, having a fabric density of 200-250 gm/m$^2$, and a center front height of 9 in. to 16 in., wherein the band is capable of expanding and stretching so as to be firmly but comfortably worn around the torso of a woman during pregnancy or postpartum approximately at the waist and retain unfastened pre-pregnancy clothes in place while providing a fitted appearance of the pre-pregnancy clothes.

16. A garment comprising:

a cylindrical band of uniform circumference formed from 90% nylon and 10% spandex, having a fabric density of 230-280 gm/m$^2$, and a center front height of 9 in. to 16 in., wherein the band is capable of expanding and stretching so as to be firmly but comfortably worn around the torso of a woman during pregnancy or postpartum approximately at the waist and retain unfastened pre-pregnancy clothes in place while providing a fitted appearance of the pre-pregnancy clothes.

17. A garment comprising:

a cylindrical band of uniform circumference formed from 84% nylon and 16% spandex, having a fabric density of 260-310 gm/m$^2$, and a center front height of 9 in. to 16 in., wherein the band is capable of expanding and stretching so as to be firmly but comfortably worn around the torso of a woman during pregnancy or postpartum approximately at the waist and retain unfastened pre-pregnancy clothes in place while providing a fitted appearance of the pre-pregnancy clothes.

* * * * *